US008215598B1

(12) United States Patent
Hausberger

(10) Patent No.: US 8,215,598 B1
(45) Date of Patent: Jul. 10, 2012

(54) HANGING DISPLAY DEVICE FOR CARDS AND THE LIKE

(76) Inventor: Stefan Hausberger, Nashua, NH (US)

( * ) Notice: Subject to any disclaimer, the term of this patent is extended or adjusted under 35 U.S.C. 154(b) by 63 days.

(21) Appl. No.: 12/622,349

(22) Filed: Nov. 19, 2009

(51) Int. Cl.
*A47G 1/17* (2006.01)

(52) U.S. Cl. ..... 248/206.5; 248/317; 248/320; 248/322; 248/683; 248/466; 248/309.4

(58) Field of Classification Search ..... 248/317, 248/320, 322, 206.5, 683, 466, 309.4; 40/124.03, 40/600, 729, 711, 617; 63/900; 24/303
See application file for complete search history.

(56) References Cited

U.S. PATENT DOCUMENTS

| | | | | | |
|---|---|---|---|---|---|
| 2,042,672 | A | | 6/1936 | Maclean | |
| 2,557,399 | A | * | 6/1951 | Teetor | 40/124.04 |
| 3,030,718 | A | * | 4/1962 | Kirkman | 40/617 |
| 3,107,361 | A | * | 10/1963 | Glutting, Sr. | 4/558 |
| 3,581,419 | A | | 6/1971 | McCracken | |
| D231,299 | S | | 4/1974 | Berchert | |
| 3,827,020 | A | * | 7/1974 | Okamoto | 335/285 |
| 4,860,477 | A | * | 8/1989 | Gooch | 40/603 |
| 5,067,618 | A | * | 11/1991 | Johnson | 211/85.3 |
| 5,087,145 | A | | 2/1992 | Cooley | |
| D390,871 | S | | 2/1998 | Whitney | |
| 5,895,018 | A | * | 4/1999 | Rielo | 248/206.5 |
| 6,189,250 | B1 | * | 2/2001 | Bell | 40/711 |
| D444,633 | S | | 7/2001 | Henick | |
| D463,674 | S | | 10/2002 | Wu | |
| 6,832,944 | B2 | * | 12/2004 | Ostrow | 446/236 |
| 6,833,507 | B2 | * | 12/2004 | Arkin et al. | 174/135 |
| 6,866,237 | B2 | * | 3/2005 | Dagan | 248/441.1 |
| 7,178,207 | B2 | * | 2/2007 | Wong et al. | 24/303 |
| D587,467 | S | | 3/2009 | van der Lande | |
| 7,523,910 | B2 | * | 4/2009 | Moran | 248/317 |
| 7,629,044 | B2 | * | 12/2009 | Iwasaki | 428/343 |
| 7,946,246 | B2 | * | 5/2011 | Silverman | 118/500 |
| 2001/0054245 | A1 | | 12/2001 | Williams | |
| 2002/0078612 | A1 | | 6/2002 | Meacham et al. | |
| 2007/0284498 | A1 | * | 12/2007 | Moran | 248/317 |

* cited by examiner

*Primary Examiner* — Terrell McKinnon
*Assistant Examiner* — Michael McDuffie

(57) ABSTRACT

A hanging display device for decoratively displaying an item comprising an elongated cable constructed from a material comprising a metal surrounded by a plastic coating; a plurality of first half magnets disposed along the cable, the first half magnets can each engage a second half magnet disposed on the item; a loop disposed on the first end of the cable for allowing the cable to be mounted on an object; and a weighted component disposed on the second end of the cable for helping to keep the cable elongated.

6 Claims, 3 Drawing Sheets

100

HANGING DISPLAY DEVICE FOR CARDS AND THE LIKE

FIELD OF THE INVENTION

The present invention is directed to a display device, more particularly to a hanging display device for displaying cards, photographs, art, postcards, business cards, baseball cards, and the like.

BACKGROUND OF THE INVENTION

Photographs and other items such as postcards, baseball cards, and the like, are often displayed in frames or other rigid devices. The present invention features a hanging display device for hanging cards, photographs, art, postcards, business cards, baseball cards, and many other items.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED. EMBODIMENTS

Figure 1:
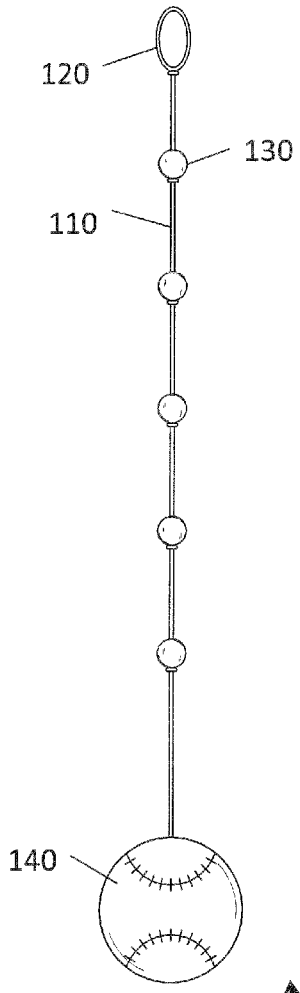
FIG. 1 is a front view of the hanging display device of the present invention.
Figure 2:
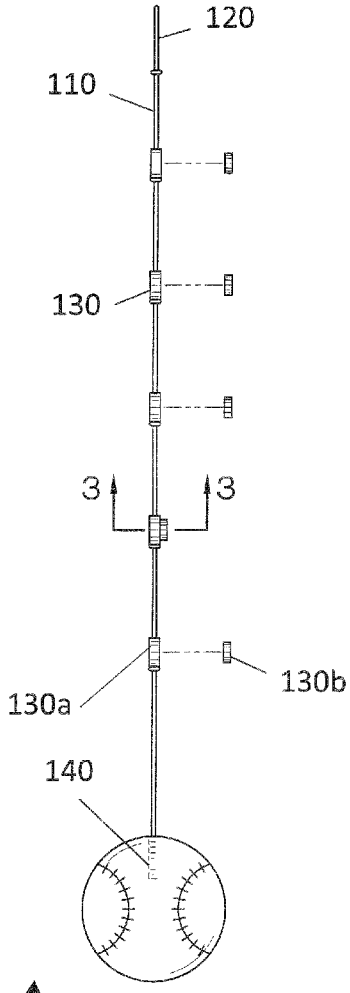
FIG. 2 is a side view of the hanging display device of FIG. 1.
Figure 3:
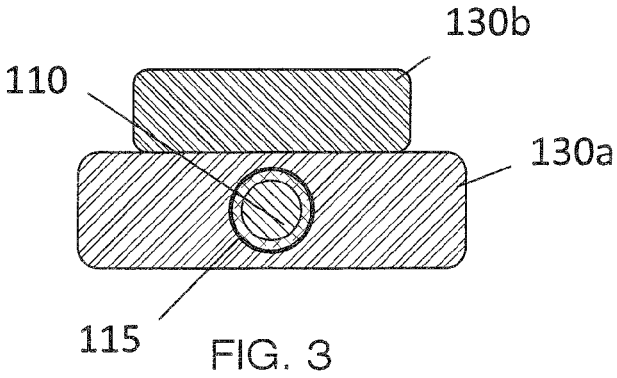
FIG. 3 is a cross sectional view of the hanging display device of FIG. 1.
Figure 4:
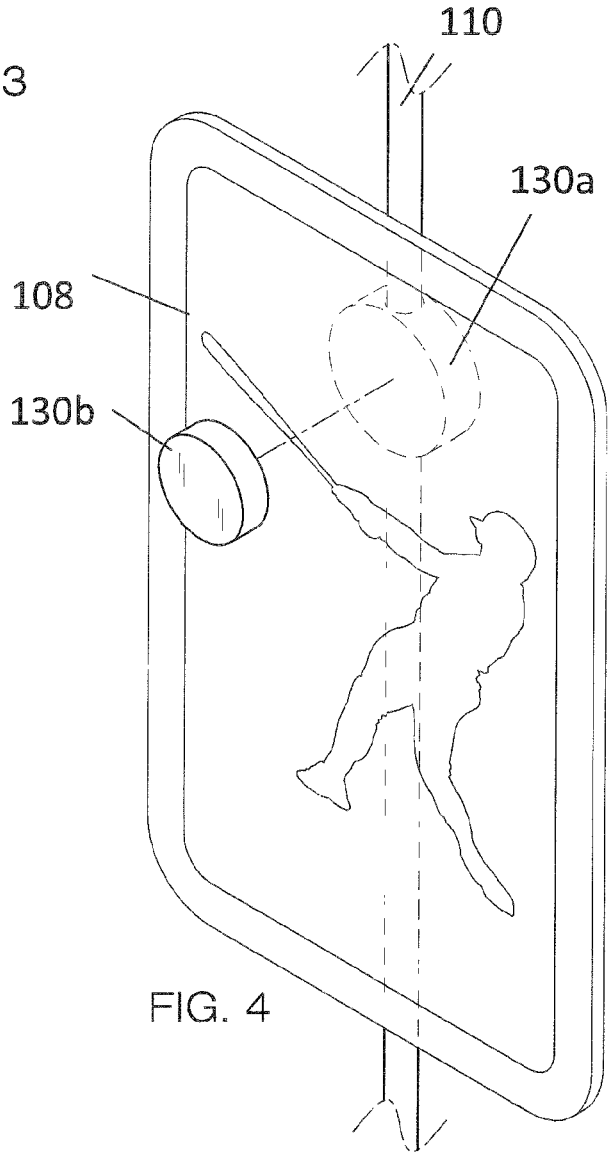
FIG. 4 is a perspective view of an alternative embodiment of the hanging display device of the present invention.
Figure 5:
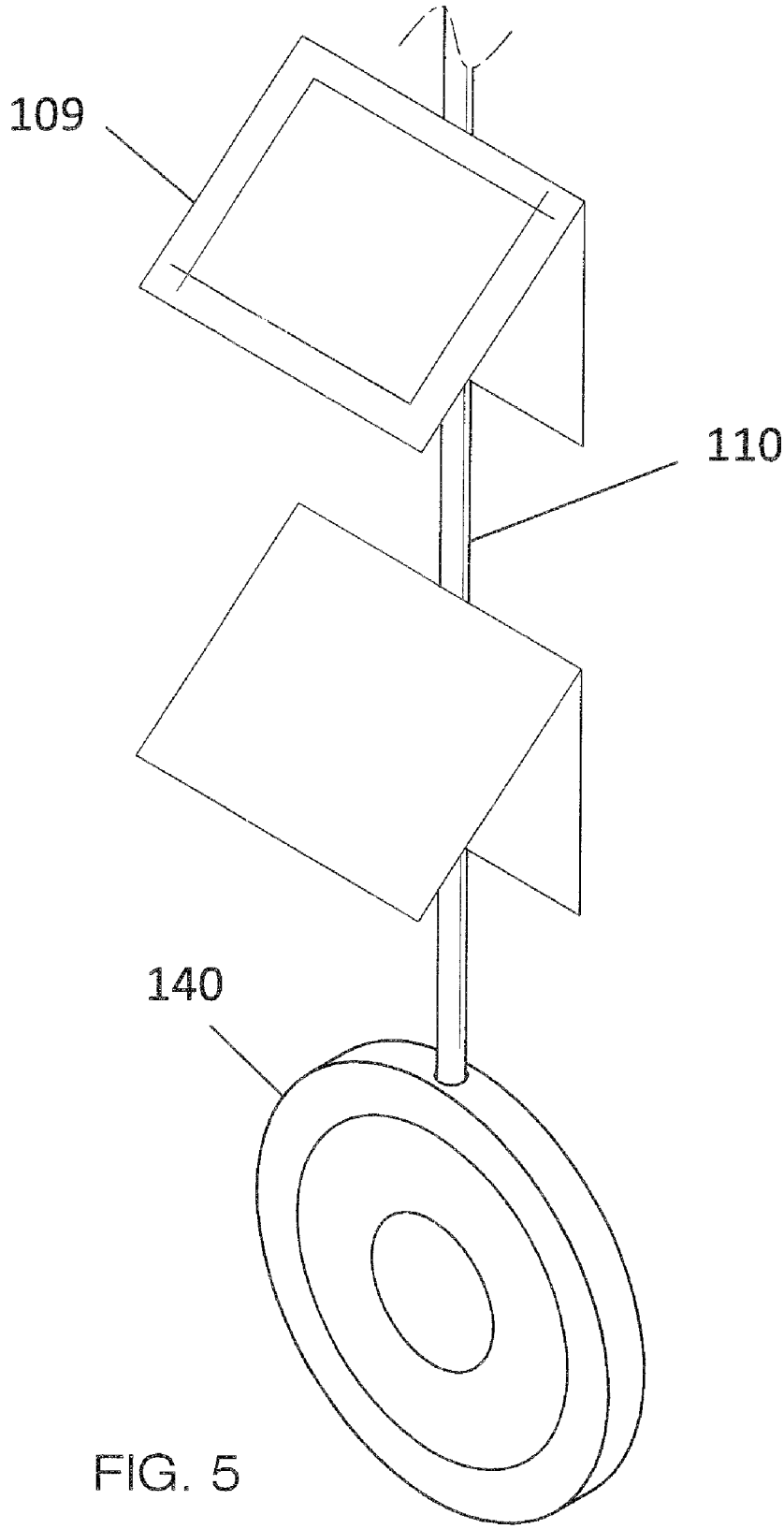
FIG. 5 is a perspective view of an alternative embodiment of the hanging display device of the present invention.

Referring now to FIGS. 1-5, the present invention features a hanging display device 100 for displaying a variety of items in a decorative way. Items that may be displayed include but are not limited to cards (e.g., greeting cards 109), art, photographs, postcards, business cards, collections such as baseball cards 108, and the like. The hanging display device 100 provides a means of easily displaying and securing these items in a variety of different locations.

The hanging display device 100 of the present invention comprises an elongated cable 110 having a first end and a second end. Disposed on the first end of the cable 110 is a mounting component (e.g., a loop 120). The mounting component (e.g., loop 120) provides a means of attaching the cable 110 to a variety of locations. For example, mounting component (e.g., the loop 120) may be attachable to a nail or screw in a wall, a doorknob, a banister, a door knocker, and a variety of other objects.

The cable 100 may be constructed from a variety of materials and in a variety of sizes. For example, in some embodiments, the cable 110 is constructed from a material comprising metal (e.g., steel), plastic, the like, or a combination thereof. In some embodiments, the cable 110 (e.g., metal, steel) is coated with a material comprising a plastic (e.g., a plastic coating 115). In some embodiments, the cable 110 is between about 2 to 3 feet in length as measured from the first end to the second end. In some embodiments, the cable 110 is between about 3 to 4 feet in length as measured from the first end to the second end. In some embodiments, the cable 110 is between about 4 to 5 feet in length as measured from the first end to the second end. In some embodiments, the cable 110 is more than about 5 feet in length.

The items (e.g., greeting cards, postcards, photographs, art, etc.) may be secured to the cable 116 via an attachment means. In some embodiments, the attachment means includes a magnet system 130. For example, in some embodiments, a plurality of first half magnets 130*a* is disposed along the cable 110. The first half magnets are for engaging second half magnets 130*b*, which are disposed on the items (e.g., greeting cards, postcards, photographs, art, etc.). A user can simply connect the magnets 130 together to temporarily attach the items to the cable 110. The attachment means is not limited to a magnet mechanism.

Disposed on the second end of the cable 110 is a weighted component 140. The weighted component 140 helps to keep the cable 110 elongated. In some embodiments, the weighted component 140 can provide added decor. The weighted component 140 may be constructed in a variety of shapes. Shapes include but are not limited to spheres (e.g., baseballs), stars, triangles, animal shapes, cartoon character shapes, and the like.

The cable 110 provides a unique means of displaying the items. For example, because the cable 110 is not completely rigid and positioned in a fixed position, the items on the cable 110 can move slightly. As an example, the cable can be moved side-to-side (e.g., pendulum motion) caused by wind or a user pushing it. This provides a more aesthetically pleasing display as opposed to a rigid stick fixedly attached to an object such as a wall.

The present invention also features a method of displaying an item. The method comprises obtaining a display device 100 of the present invention and attaching a second half magnet 130*b* to the item. The second half magnet 130*b* can then be attached to a first half magnet 130*a* on the cable 110.

As used herein, the term "about" refers to plus or minus 10% of the referenced number. For example, an embodiment wherein the cable 110 is about 5 feet in length includes a cable 110 that is between 4.5 and 5.5 feet in length.

The following the disclosures of the following U.S. Patents are incorporated in their entirety by reference herein: U.S. Pat. No. 2,042,672; U.S. Pat. Application No. 2001/0054245; U.S. Pat. No. 3,581,419; U.S. Pat. No. 5,087,145; U.S. Pat. Application No. 2002/0078612.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A hanging display device for decoratively displaying an item, said display device comprising:

(a) an elongated cable having a first end and a second end, the cable being constructed From a material comprising a metal, the metal being surrounded by a plastic coating;

(b) a plurality of first half magnets permanently disposed along the cable, the first half magnets can each magnetically attach to a second half magnet disposed on the item, thereby facilitating attachment of a card without physically puncturing the card;

(c) a mounting component disposed on the first end of the cable for allowing the cable 4.0 be mounted on an object; and (d) a weighted component disposed on the second end of the cable for helping to keep the cable elongated.

2. The hanging display device of claim 1, wherein the item is a card, a greeting card, a piece of art, a photograph, a postcard, a business card, or a baseball card.

3. The hanging display device of claim 1, wherein the cable is between about 2 to 5 feet in length as measured from the first end to the second end.

4. The hanging display device of claim 1, wherein the cable is more than about 5 feet in length.

5. The hanging display device of claim 1, wherein the mounting component is a loop.

6. The hanging display device of claim 1, wherein the weighted component is has a shape that is a sphere, a baseball, a star, a triangle, an animal shape, or a cartoon character shape.

* * * * *